US010454150B2

(12) United States Patent
Hou et al.

(10) Patent No.: US 10,454,150 B2
(45) Date of Patent: Oct. 22, 2019

(54) RADIO FREQUENCY WAVEGUIDE DEVICES INCLUDING A DIELECTRIC HAVING OTHER EXTERIOR SURFACES WITH A FEATURE THEREON AND COATED BY A METAL LAYER

(71) Applicants: Peter Hou, Gaithersburg, MD (US); Hamad Alsawaha, Gaithersburg, MD (US); Thomas Jackson, Frederick, MD (US); Bingqian Lu, Silver Spring, MD (US); Yilin Mao, Gaithersburg, MD (US)

(72) Inventors: Peter Hou, Gaithersburg, MD (US); Hamad Alsawaha, Gaithersburg, MD (US); Thomas Jackson, Frederick, MD (US); Bingqian Lu, Silver Spring, MD (US); Yilin Mao, Gaithersburg, MD (US)

(73) Assignee: Hughes Network Systems, LLC, Germantown, MD (US)

( * ) Notice: Subject to any disclaimer, the term of this patent is extended or adjusted under 35 U.S.C. 154(b) by 0 days.

(21) Appl. No.: 15/395,395

(22) Filed: Dec. 30, 2016

(65) Prior Publication Data

US 2018/0191048 A1 Jul. 5, 2018

(51) Int. Cl.

| | |
|---|---|
| ***H01P 3/12*** | (2006.01) |
| ***H01P 3/16*** | (2006.01) |
| ***H01P 1/20*** | (2006.01) |
| ***H01P 1/17*** | (2006.01) |
| ***H01P 1/161*** | (2006.01) |

(52) U.S. Cl.
CPC ..... *H01P 3/122* (2013.01); *H01P 1/161* (2013.01); *H01P 1/171* (2013.01); *H01P 1/172* (2013.01); *H01P 1/2002* (2013.01); *H01P 3/16* (2013.01)

(58) Field of Classification Search
CPC .. H01P 3/12; H01P 3/121; H01P 3/122; H01P 1/2002; H01P 1/161; H01P 1/72; H01P 1/172
USPC ..... 333/239, 208, 21 A, 137
See application file for complete search history.

(56) References Cited

U.S. PATENT DOCUMENTS

| | | | | |
|---|---|---|---|---|
| 2,897,461 | A * | 7/1959 | Ashbaugh et al. | H01P 3/122 333/239 |
| 4,568,943 | A * | 2/1986 | Bowman | H01P 1/172 333/137 |
| 4,647,882 | A * | 3/1987 | Landis | H01P 3/121 29/600 |
| 2008/0036558 | A1* | 2/2008 | Suarez-Gartner et al. | H01P 3/127 333/239 |
| 2016/0056860 | A1* | 2/2016 | Okada | H04B 3/52 375/257 |
| 2016/0268667 | A1* | 9/2016 | Yatabe | H01P 1/2002 |
| 2017/0141450 | A1* | 5/2017 | Bae et al. | H01P 3/122 |

* cited by examiner

*Primary Examiner* — Benny T Lee
(74) *Attorney, Agent, or Firm* — Capitol City Techlaw; Jasbir Singh

(57) ABSTRACT

A radio frequency waveguide is disclosed. The radio frequency waveguide includes: a dielectric including an exterior input surface, an exterior output surface and other exterior surfaces; and a metal disposed on the other exterior surfaces of the dielectric, wherein the dielectric is voidless and adapted to propagate radio frequency radiation from the exterior input surface to the exterior output surface.

18 Claims, 3 Drawing Sheets

RADIO FREQUENCY WAVEGUIDE DEVICES INCLUDING A DIELECTRIC HAVING OTHER EXTERIOR SURFACES WITH A FEATURE THEREON AND COATED BY A METAL LAYER

FIELD

The present teachings disclose a low-cost waveguide device and a method for manufacturing of same. In particular, a low-cost waveguide device formed by a dielectric whose exterior surfaces are wholly or partially covered by a metal is disclosed.

BACKGROUND

Prior-art waveguide devices, including but not limited to an Ortho-Mode Transducer (OMT), polarizer, filter, and feed horn use air trapped in hollow internal cavities as a dielectric. The internal cavities are surrounded by conductive walls typically made of metals. The RF waves travel through air, the dielectric, in the cavities of these devices, and are bounced back or reflected by the conductive walls defining the cavities.

FIG. 1A and FIG. 1B illustrate a prior art disassembled waveguide, an Ortho-Mode Transducer (OMT), defining a cavity for waveguide propagation through a dielectric of air according to various embodiments.

FIG. 2A and FIG. 2B illustrate a prior art disassembled waveguide, a polarizer, defining a cavity for waveguide propagation through a dielectric of air according to various embodiments.

FIG. 3A and FIG. 3B illustrate a prior art disassembled waveguide, a bandpass filter, defining a cavity for waveguide propagation through a dielectric of air according to various embodiments.

As illustrated by FIG. 1A, FIG. 1B, FIG. 2A, FIG. 2B, FIG. 3A and FIG. 3B, most waveguide devices are not manufactured as a single piece. Instead, the waveguide devices have to be manufactured in two or more pieces, typically using either machining, injecting or die-casting. The two or more pieces are then assembled into a final device. The final device has disadvantages including high costs associated with die-casting, higher costs of assembling, and difficulties in precisely aligning the two or more pieces. This is an increasing problem as the operating frequency is increased.

Additionally, the prior art devices use air as a dielectric, in other words, the air disposed in cavities defined by metal enclosures. Features of the waveguide are defined in the cavity-facing surfaces of the metal enclosure. The radio frequency waves propagated through the waveguide, travel in the air and bounce off the metal surfaces of the enclosure, and are thus affected by the waveguide device. As such, the radio frequency waves are manipulated by the metal boundary conditions of the metal enclosure around the cavity containing the air (dielectric). Moreover, these devices are bulky—physically large. The bulkiness hinders the miniaturization of the final products, such as, a fixed Very Small Aperture Terminal (VSAT), or a mobile VSAT.

SUMMARY OF THE INVENTION

This Summary of the Invention is provided to introduce a selection of concepts in a simplified form that is further described below in the Detailed Description of the Invention. This Summary of the Invention is not intended to identify key features or essential features of the claimed subject matter, nor is it intended to be used to limit the scope of the claimed subject matter.

According to various embodiments, a radio frequency waveguide is disclosed. The radio frequency waveguide includes: a dielectric including an exterior input surface, an exterior output surface and other exterior surfaces; and a metal disposed on the other exterior surfaces of the dielectric, wherein the dielectric is voidless and adapted to propagate radio frequency radiation from the exterior input surface to the exterior output surface.

According to various embodiments, a radio frequency waveguide is disclosed. The radio frequency waveguide includes: a dielectric formed of a plastic including an exterior input surface, an exterior output surface and other exterior surfaces; and a metal disposed on the other exterior surfaces of the dielectric, wherein the metal is disposed on the dielectric by electro-plating the metal thereupon, wherein the dielectric is voidless and adapted to propagate radio frequency radiation from the exterior input surface to the exterior output surface.

Additional features will be set forth in the description that follows, and in part will be apparent from the description, or may be learned by practice of what is described.

BRIEF DESCRIPTION OF THE DRAWINGS

In order to describe the manner in which the above-recited and other advantages and features may be obtained, a more particular description is provided below and will be rendered by reference to specific embodiments thereof which are illustrated in the appended drawings. Understanding that these drawings depict only typical embodiments and are not therefore to be considered to be limiting of its scope, implementations will be described and explained with additional specificity and detail through the use of the accompanying drawings.

The present teachings disclose a low-cost waveguide device and a method for manufacturing of same. In particular, a low-cost waveguide device formed by a dielectric whose exterior surfaces are wholly or partially covered by a metal is disclosed. In some embodiments, the dielectric is shaped as the hollow or cavity of a prior-art waveguide; in other words, the dielectric is shaped as a negative or inverse of essentially a prior art assembled waveguide.

Figure 1A:
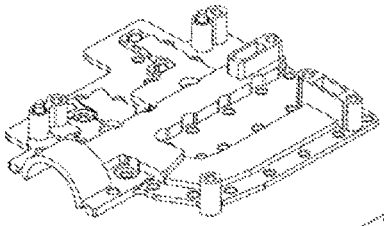
FIG. 1A (PRIOR ART)
FIG. 1A and FIG. 1B illustrate a prior art disassembled waveguide, an Ortho-Mode Transducer (OMT), defining a cavity for waveguide propagation through a dielectric of air according to various embodiments.
Figure 1B:
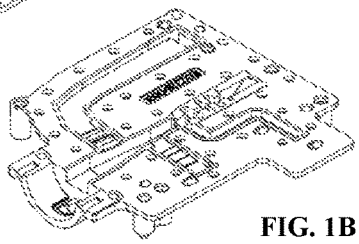
FIG. 1B (PRIOR ART)
Figure 2A:
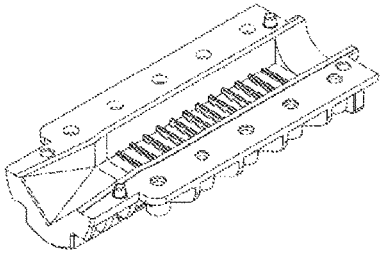
FIG. 2A (PRIOR ART)
FIG. 2A and FIG. 2B illustrate a prior art disassembled waveguide, a polarizer, defining a cavity for waveguide propagation through a dielectric of air according to various embodiments.
Figure 2B:
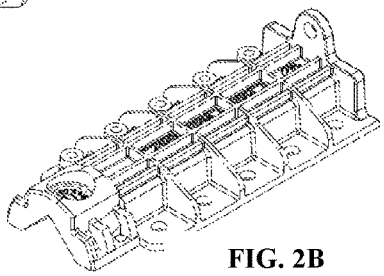
FIG. 2B (PRIOR ART)
Figure 3A:
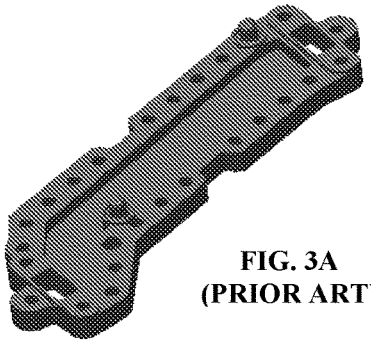
FIG. 3A (PRIOR ART)
FIG. 3A and FIG. 3B illustrate a prior art disassembled waveguide, a bandpass filter, defining a cavity for waveguide propagation through a dielectric of air according to various embodiments.
Figure 3B:
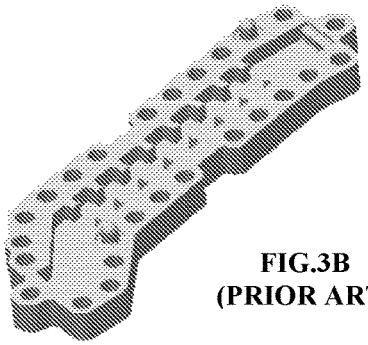
FIG.3B (PRIOR ART)

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION OF THE INVENTION

Embodiments are discussed in detail below. While specific implementations are discussed, it should be understood that this is done for illustration purposes only. A person skilled in the relevant art will recognize that other components and configurations may be used without parting from the spirit and scope of the subject matter of this disclosure.

The terminology used herein is for describing particular embodiments only and is not intended to be limiting of the present disclosure. As used herein, the singular forms "a," "an" and "the" are intended to include the plural forms as well, unless the context clearly indicates otherwise. Furthermore, the use of the terms "a," "an" etc. does not denote a limitation of quantity, but rather denotes the presence of at least one of the referenced item. The use of the terms "first," "second," and the like does not imply any particular order, but they are included to either identify individual elements or to distinguish one element from another. It will be further understood that the terms "comprises" and/or "comprising", or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof. Although some features may be described with respect to individual exemplary embodiments, aspects need not be limited thereto such that features from one or more exemplary embodiments may be combinable with other features from one or more exemplary embodiments.

The present teachings disclose a waveguide device, including but not limited to an OMT, a polarizer, a filter, a feed horn, a delay line, a phase shifter, a resonator or the like. The present teachings disclose a radio frequency waveguide that does not include hollow cavities to propagate radio frequency waves; instead, the radio frequency waveguide is made of a solid dielectric material, such as, a plastic, a ceramic or other non-conductive material. Most of the exterior surfaces of the radio frequency waveguide are covered or coated by a metal; only a radio frequency waveguides exterior input and output surfaces are left uncovered or uncoated by a metal. In exemplary embodiments, most of the external surfaces of these radio frequency devices are plated with a conductive material, for example, copper. The RF waves travel through the solid dielectric materials, and prevented from radiating out of the dielectric material by the conductive material disposed on the exterior surfaces of the dielectric material. In other words, the RF waves bounce-off or bounce back from the conductive material disposed on the outer surfaces of the dielectric.

As only a single, generally unitary, piece of appropriately shaped dielectric material is needed for manufacturing, the manufacturing costs are much reduced as the single piece completely negates the need for assembly. In exemplary embodiments, the radio frequency waveguide may be made from plastic injection molding that is, for example, much lower in cost than the equivalent metal die-casting. Even with the metal plating disposed on the outer surfaces, the overall manufacturing costs are much lower than the prior-art.

Further, the present radio frequency waveguides do not suffer from RF performance degradations generally associated with misalignment of assembled waveguides and RF leakage associated therewith. The prior-art method of using at least a two-part assembly, alignment pins and interface flatness control, all add costs while being vulnerable to RF performance degradations due to alignment issues. For example, at the RF frequency of Ka-band, the alignment of the two-halves typically need to be tighter than 0.001" (inches) by the use of alignment pins, or degradation in the form of increased VSWR, increased axial ratio, and increase insertion loss. Similarly, the mating surfaces typically also need to be flat within 0.001" to control RF leaks that result in degraded isolation and increased insertion loss.

Additionally, the resulting radio frequency waveguide may be of a much smaller physical size. The dielectric through which the RF waves travel, allows the volume of the waveguide device to be made smaller than a counterpart waveguide which is hollow, for example, by a factor of $\varepsilon_r^{-3/2}$, where $\varepsilon_r$ is the dielectric's dielectric constant relative to that of air. The dielectric constant for most plastics and ceramics ranges typically from about 2 to about 16. This allows the miniaturization of the entire product and/or system utilizing the radio frequency waveguide. Exemplary devices utilizing radio frequency waveguides include the stationary or mobile VSAT, a gateway, antenna systems, or the like. The miniaturization results in additional cost savings for enclosures etc.

As an example, when a waveguide filter is made of a plastic having a $\varepsilon_r$ of four (4), which is very common, the filter's linear dimensions are shrunk to ½ of that of a hollow waveguide, and its volume shrinks to ⅛ of the equivalent prior-art devices. Without limitation, by using materials of higher dialectical constants, the devices can be made as small as 1/64 of the functional equivalent devices made using the prior-art.

In some embodiments, two or more dielectrics having different dielectric constants can be used in one waveguide. In some embodiments, the two or more dielectrics may be used as a mixture. In some embodiments, the two or more dielectrics may be used along one another.

Figure 4:
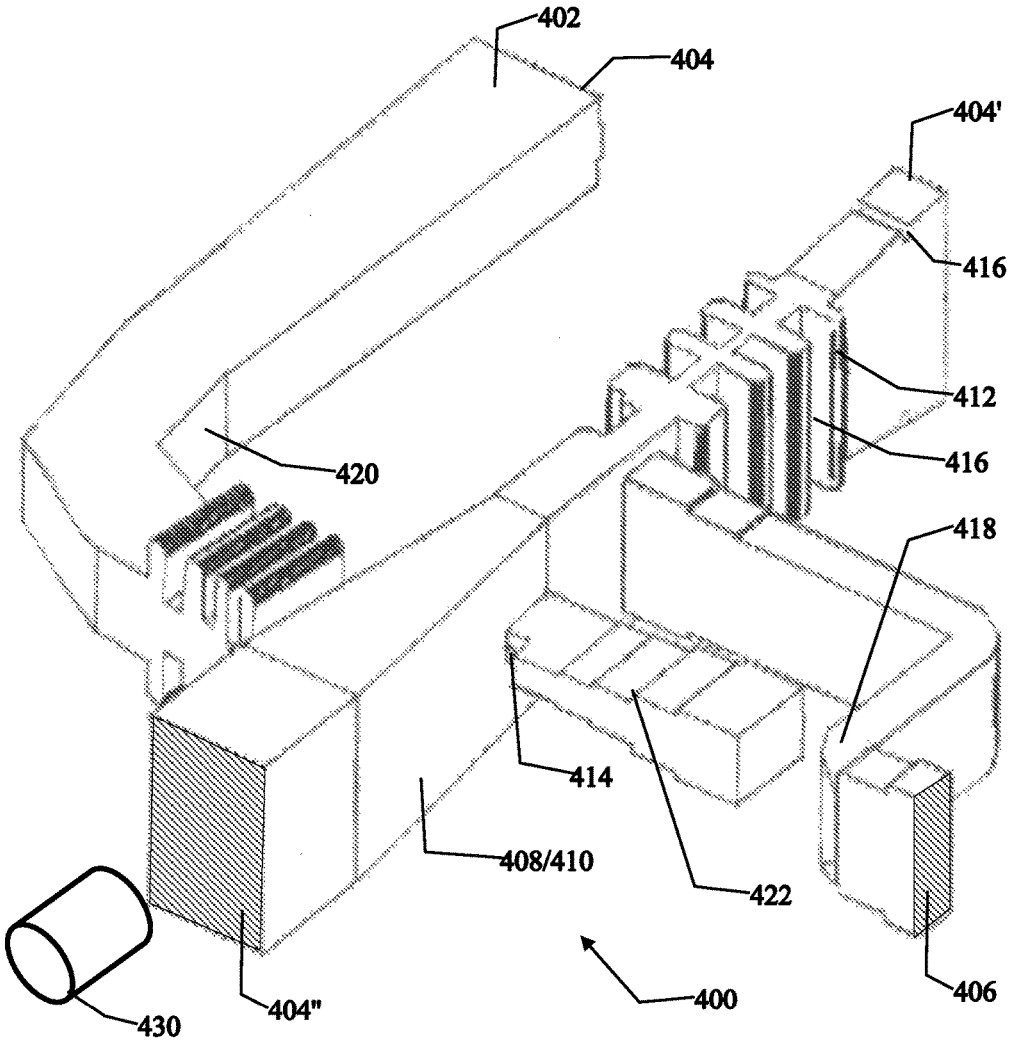
FIG. 4 illustrates a radio frequency waveguide Ortho-Mode Transducer (OMT) according to various embodiments.

FIG. 4 illustrates a radio frequency waveguide Ortho-Mode Transducer (OMT) according to various embodiments.

A radio frequency waveguide Ortho-Mode Transducer (OMT) 400 may be formed of a dielectric 402 that is free of voids by design or voidless. An exterior input surface 404 (not visible; also known as receive port 1), exterior input surface 404' (not visible; also known as receive port 2) and exterior input surface 404" (also known as common port) of the OMT 400 are free of metal—free of metal is illustrated with a hash pattern in FIG. 4. The exterior input surfaces 404, 404', 404" of the OMT 400 may be shaped as desired, for example, as a rectangle. An exterior output surface 406 (also known as the transmit port) is free of metal—free of metal is illustrated with a hash pattern in FIG. 4. The exterior output surface 406 of the OMT 400 may be shaped as desired, for example, as a rectangle. All other exterior surfaces 408 of the OMT 400 have a metal 410 disposed thereupon—metal 410 is illustrated either as a white or black surface in FIG. 4. The metal 410 may be selected from alloys of copper, gold, silver or aluminum. The other exterior surfaces 408 of the OMT 400 may include one or more features. The OMT 400 may include features such as a ridge 412, an iris 414 (narrow connection between two portions of the dielectric 402), a valley 416, a curved turn 418, an angled turn 420, steps 422 or the like. In exemplary embodiments, a wire 430 may be disposed proximate the exterior input surface 404".

Figure 5:
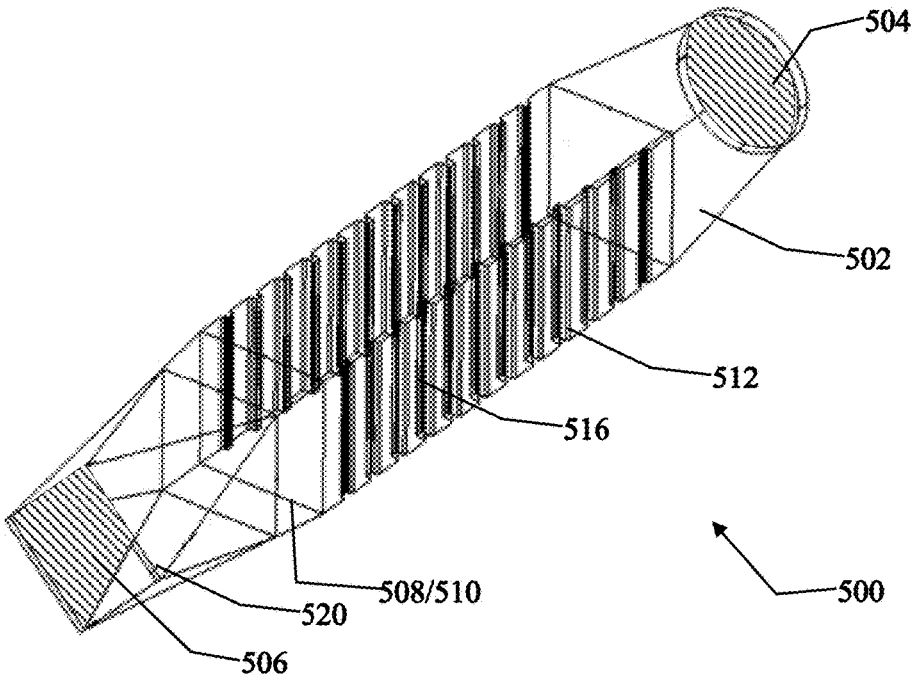
FIG. 5 illustrates a radio frequency waveguide polarizer according to various embodiments.

FIG. 5 illustrates a radio frequency waveguide polarizer according to various embodiments.

A radio frequency waveguide polarizer 500 may be formed of a dielectric 502 that is free of voids. An exterior input surface 504 of the polarizer 500 is free of metal—free of metal is illustrated with a hash pattern in FIG. 5. The exterior input surface 504 of the polarizer 500 may be shaped as desired, for example, as a rectangle, a circle, or the like. An exterior output surface 506 is free of metal—free of metal is illustrated with a hash pattern in FIG. 5. The exterior output surface 506 of the polarizer 500 may be shaped as desired, for example, as a rectangle, a circle or the like. All other exterior surfaces 508 of the polarizer 500 have a metal 510 disposed thereupon—metal 510 is illustrated either as a white or black surface in FIG. 5. The other exterior surfaces 508 of the polarizer 500 may include one or more features. The polarizer 500 may include features such as a ridge 512, a valley 516, an angled turn 520, or the like.

Figure 6:
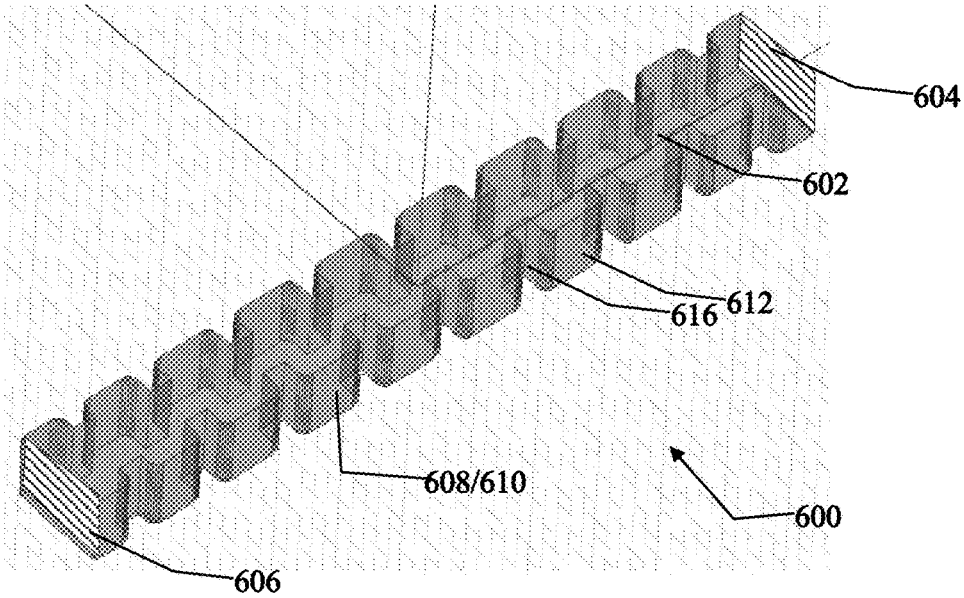
FIG. 6 illustrates a radio frequency waveguide bandpass filter according to various embodiments.

FIG. 6 illustrates a radio frequency waveguide bandpass filter according to various embodiments.

A radio frequency waveguide bandpass filter 600 may be formed of a dielectric 602 that is free of voids. An exterior input surface 604 of the bandpass filter 600 is free of metal—free of metal is illustrated with a hash pattern in FIG. 6. The exterior input surface 604 of the bandpass filter 600 may be shaped as desired, for example, as a rectangle, a circle, or the like. An exterior output surface 606 is free of metal—free of metal is illustrated with a hash pattern in FIG. 6. The exterior output surface 606 of the bandpass filter 600 may be shaped as desired, for example, as a rectangle, a circle or the like. All other exterior surfaces 608 of the bandpass filter 600 may have a metal 610 disposed thereupon—metal 610 is illustrated either as a white or black surface in FIG. 6. The other exterior surfaces 608 of the bandpass filter 600 may include one or more features. The bandpass filter 600 may include features such as a ridge 612, a valley 616, or the like.

In exemplary embodiments, metal 410 of FIG. 4, metal 510 of FIG. 5 and metal 610 of FIG. 6 may be disposed on the respective other exterior surfaces of the respective dielectrics as a thin film, a coating, a foil, a metal deposit by electroplating or the like. In exemplary embodiments, the free of metal surfaces of the various exterior input and output surfaces may be freed of a universally applied metal to the exterior of the various dielectrics by removing them, for example, by scratching, abrasives or the like.

In exemplary embodiments, a radio frequency wave is input via the exterior input surface by disposing a wire proximate the exterior input surface. In exemplary embodiments, a radio frequency waveguide maybe secured to the support without piercing the metal, for example, with an adhesive, a clamp, a friction fit, or the like.

Injection molding may be used to produce waveguides when, for example, the selected dielectric is formed with plastic. Plastic injection molding is high efficiency production method that is amenable to automatic production and permits use of multiple materials to be molded at the same time with many different types of plastics. Furthermore, in mold decoration technology allows features of the waveguide to be molded together with the main portion of the waveguide without use of a secondary process after molding. Injection molding also allows for repeatable production of waveguides with high tolerances, for example, within 0.01 mm or better. However, waveguides designed for manufacturing by injection molding must follow the basic rules of injection molding, for example, by avoiding an uneven wall thickness, by avoiding complicated interior surfaces, and by providing a draft angle for better demolding. The present teachings avoid these problems as generally no interior surfaces are needed.

Although the subject matter has been described in language specific to structural features and/or methodological acts, it is to be understood that the subject matter in the appended claims is not necessarily limited to the specific features or acts described above. Rather, the specific features and acts described above are disclosed as example forms for implementing the claims. Other configurations of the described embodiments are part of the scope of this disclosure. Further, implementations consistent with the subject matter of this disclosure may have more or fewer acts than as described, or may implement acts in a different order than as shown. Accordingly, the appended claims and their legal equivalents should only define the invention, rather than any specific examples given.

We claim as our invention:

1. A radio frequency waveguide comprising:

a dielectric comprising an exterior input surface forming an exterior input surface of the radio frequency waveguide, configured to receive radio frequency radiation as an input to the radio frequency waveguide, an exterior output surface forming an exterior output surface of the radio frequency waveguide, configured to transmit the radio frequency radiation as an output from the radio frequency waveguide, and other exterior surfaces; and a metal disposed on the entirety of the other exterior surfaces of the dielectric, wherein the dielectric is voidless and adapted to propagate the radio frequency radiation from the exterior input surface to the exterior output surface, and wherein the exterior input surface of the dielectric, the exterior output surface of the dielectric, the metal disposed on the entirety of the other exterior surfaces of the dielectric constitute an outermost surface of the radio frequency waveguide, and the other exterior surfaces comprise a feature selected from a ridge, an iris, a valley, a curved turn, an angled turn, or a step.

2. The radio frequency waveguide of claim 1, wherein the dielectric has a dielectric constant greater than 1.

3. The radio frequency waveguide of claim 1, wherein the dielectric comprises a mixture of two or more dielectrics.

4. The radio frequency waveguide of claim 1, wherein the dielectric comprises a plastic or a ceramic.

5. The radio frequency waveguide of claim 1, wherein the dielectric is a unitary construction.

6. The radio frequency waveguide of claim 1, wherein the dielectric is a unitary construction formed by injection molding.

7. The radio frequency waveguide of claim 1, wherein the metal is disposed on the dielectric as a metal foil.

8. The radio frequency waveguide of claim 1, wherein the metal is disposed on the dielectric by electro-plating the metal thereupon.

9. The radio frequency waveguide of claim 1, wherein a reduction in a volume of the dielectric having a dielectric constant $\varepsilon_r$ relative to that of air is greater than or equal to a factor of $\varepsilon_r^{-3/2}$.

10. The radio frequency waveguide of claim 1, wherein the radio frequency waveguide comprises an Ortho-Mode Transducer (OMT).

11. The radio frequency waveguide of claim 1, wherein the radio frequency waveguide comprises a polarizer.

12. The radio frequency waveguide of claim 1, wherein the radio frequency waveguide comprises a bandpass filter.

13. The radio frequency waveguide of claim 1, the radio frequency waveguide is selected from a filter, a feed horn, a delay line, a phase shifter, or a resonator.

14. The radio frequency waveguide of claim 1, wherein a radio frequency wave is input via the exterior input surface by disposing a wire proximate the exterior input surface.

15. A radio frequency waveguide comprising:

a dielectric formed of a plastic comprising an exterior input surface forming an exterior input surface of the radio frequency waveguide, configured to receive radio frequency radiation as an input to the radio frequency waveguide, an exterior output surface forming an exterior output surface of the radio frequency waveguide, configured to transmit the radio frequency radiation as an output from the radio frequency waveguide, and other exterior surfaces; and a metal disposed on the entirety of the other exterior surfaces of the dielectric, wherein the metal is disposed on the dielectric by electro-plating the metal thereupon, wherein the dielectric is voidless and adapted to propagate the radio frequency radiation from the exterior input surface to the exterior output surface, and wherein the exterior input surface of the dielectric, the exterior output surface of the dielectric, the metal disposed on the entirety of the other exterior surfaces of the dielectric constitute an outermost surface of the radio frequency waveguide, and the other exterior surfaces comprise a feature selected from a ridge, an iris, a valley, a curved turn, an angled turn, or a step.

16. The radio frequency waveguide of claim 15, wherein the metal is selected from alloys of copper, gold, silver or aluminum.

17. The radio frequency waveguide of claim 15, wherein the dielectric comprises a mixture of two or more plastics.

18. The radio frequency waveguide of claim 15, wherein the dielectric is a unitary construction formed by injection molding.

* * * * *